US008201937B2

(12) United States Patent
Nobuta et al.

(10) Patent No.: US 8,201,937 B2
(45) Date of Patent: Jun. 19, 2012

(54) DECISION OF OPENING AND CLOSING OF OPENING SECTION OF APPARATUS

(75) Inventors: Kosaku Nobuta, Suwa (JP); Osamu Hanamura, Shiojiri (JP); Yoshiaki Shibasaki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 442 days.

(21) Appl. No.: 12/548,355

(22) Filed: Aug. 26, 2009

(65) Prior Publication Data

US 2010/0050527 A1 Mar. 4, 2010

(30) Foreign Application Priority Data

Aug. 27, 2008 (JP) ..... 2008-218197

(51) Int. Cl.
*B41J 29/13* (2006.01)

(52) U.S. Cl. ..... 347/108; 347/19

(58) Field of Classification Search ..... 347/108, 347/19

See application file for complete search history.

(56) References Cited

U.S. PATENT DOCUMENTS 7,029,006 B2 * 4/2006 Izumi et al. ..... 271/145

FOREIGN PATENT DOCUMENTS

JP 2006-264160 A 10/2006

* cited by examiner

*Primary Examiner* — Julian Huffman
(74) *Attorney, Agent, or Firm* — Kilpatrick Townsend & Stockton LLP

(57) ABSTRACT

An apparatus includes: an opening and closing mechanism that opens or closes an opening section of the apparatus; a first movable body that is moved in accordance with the operation of opening and closing the opening section by the opening and closing mechanism; a movement detector that detects the movement amount of the first movable body; a controller that determines whether or not the opening section is closed, on the basis of the detected movement amount; a second movable body disposed in the apparatus and movable; and a movement transmitting mechanism which moves the first movable body in accordance with the movement of the second movable body in a state in which the opening section is closed, and does not move the first movable body in accordance with the movement of the second movable body in a state in which the opening section is opened.

20 Claims, 9 Drawing Sheets

DECISION OF OPENING AND CLOSING OF OPENING SECTION OF APPARATUS

This application claims priority to Japanese Patent Application No. 2008-218197, filed Aug. 27, 2008, the entirety of which is incorporated by reference herein.

BACKGROUND

1. Technical Field

The present invention relates to the technology of executing decision of opening and closing of an opening section of an apparatus.

2. Related Art

An ink jet printer has an opening section for performing the mounting and detaching of, for example, an ink cartridge, and a cover for opening or closing the opening section. For the avoidance of the execution of a printing operation in a state in which the opening section is opened, and so on, in general, the ink jet printer has a decision device which executes a decision of whether or not the opening section is closed (decision of opening and closing of the opening section). As the decision device which executes the decision of opening and closing of the opening section, for example, a sensor lever which interferes in the cover, thereby being displaced when the opening section is closed by the cover, and an opening and closing sensor having a detection section for detecting the displacement of the sensor lever are used (for example, JP-A-2006-264160).

In a case where the prior opening and closing sensor is used as the decision device which executes the decision of the opening and closing of the opening section, on the grounds of the contact variation of the opening and closing sensor and the like, there was a case where although the opening section is slightly opened, the opening cannot be detected, so that the sensor decides that the opening section is closed. Further, although the sensor lever is displaced by interfering in a body other than the cover, the opening and closing sensor decides that the opening section is closed, and therefore the opening and closing state of the opening section is erroneously decided. In this manner, in the prior decision device which executes the decision of the opening and closing of the opening section, there was room for improvement in decision precision.

Also, such a problem is not limited to the decision of the opening and closing of the opening section for performing the mounting and detaching of the ink cartridge which is provided at the ink jet printer, but generally was a common problem in the case of executing the decision of the opening and closing of the opening section provided at an apparatus.

SUMMARY

An advantage of some aspects of the invention is that it provides technology enabling improvement in the precision of the decision of the opening and closing of the opening section of an apparatus.

The invention can be realized as modes or application examples described below.

According to an embodiment of the invention, there is provided an apparatus including: an opening and closing mechanism that opens or closes an opening section of the apparatus; a first movable body that is moved in accordance with the operation of opening and closing the opening section by the opening and closing mechanism; a movement detecting section that detects the movement amount of the first movable body; a determination section that determinates whether or not the opening section is closed, on the basis of the detected movement amount; a second movable body disposed in the apparatus and movable; and a movement transmitting mechanism which moves the first movable body in accordance with the movement of the second movable body in a state in which the opening section is closed, and does not move the first movable body in accordance with the movement of the second movable body in a state in which the opening section is opened.

In this apparatus, the first movable body is moved in accordance with the operation of opening and closing the opening section by the opening and closing mechanism, and whether or not the opening section is closed is decided on the basis of the detected movement amount of the first movable body. Also, in a state in which the opening section is closed, the first movable body is moved by the movement transmitting mechanism in accordance with the movement of the second movable body, and in a state in which the opening section is opened, the first movable body is not moved in accordance with the movement of the second movable body. Therefore, in this apparatus, the accuracy of the decision of the opening and closing of the opening section of the apparatus can be improved.

According to an embodiment of the invention, the first movable body is a linear scale which reciprocates in accordance with the operation of opening and closing the opening section by the opening and closing mechanism, and the movement transmitting mechanism moves the linear scale in accordance with the movement of the second movable body in a state in which the opening section is closed.

In this apparatus, the movement amount of the linear scale which reciprocates in accordance with the operation of opening and closing the opening section by the opening and closing mechanism is detected, and whether or not the opening section is closed is decided on the basis of the detected movement amount. Also, the movement transmitting mechanism moves the linear scale in accordance with the movement of the second movable body in a state in which the opening section is closed. Therefore, also in this apparatus, the accuracy of the decision of the opening and closing of the opening section of the apparatus can be improved.

According to an embodiment of the invention, the first movable body is a rotating scale which rotates in accordance with the operation of opening and closing the opening section by the opening and closing mechanism, and the movement transmitting mechanism rotates the rotating scale in accordance with the movement of the second movable body in a state in which the opening section is closed.

In this apparatus, the movement amount of the rotating scale which rotates in accordance with the operation of opening and closing the opening section by the opening and closing mechanism is detected, and whether or not the opening section is closed is decided on the basis of the detected movement amount. Also, the movement transmitting mechanism rotates the rotating scale in accordance with the movement of the second movable body in a state in which the opening section is closed. Therefore, in this apparatus, the accuracy of the decision of the opening and closing of the opening section of the apparatus can be improved.

According to an embodiment of the invention, the first movable body has a plurality of slits arranged along the movement direction thereof, and the movement detecting section includes a light emitting portion for emitting light, and a light receiving portion for receiving the light emitted from the light emitting portion, and detects the movement amount of the first movable body on the basis of signals representing a light received state by the light receiving portion.

In this apparatus, the movement detecting section can detect the movement amount of the first movable body.

According to an embodiment of the invention, in the apparatus according to any one of Application Examples 1 to 4, the second movable body is a carriage which reciprocates in the apparatus.

In this apparatus, the accuracy of the decision of the opening and closing of the opening section of the apparatus can be improved by using the carriage which reciprocates in the apparatus.

Also, the invention can be realized in various aspects and, for example, realized in modes of a method and apparatus for deciding the opening and closing of the opening section, a printing apparatus, and the like.

The invention will be described with reference to the accompanying drawings, wherein like numbers reference like elements.

DESCRIPTION OF EXEMPLARY EMBODIMENTS

Next, modes for carrying out the invention will be explained based on the following embodiments and modification examples.

First Example

Figure 1:
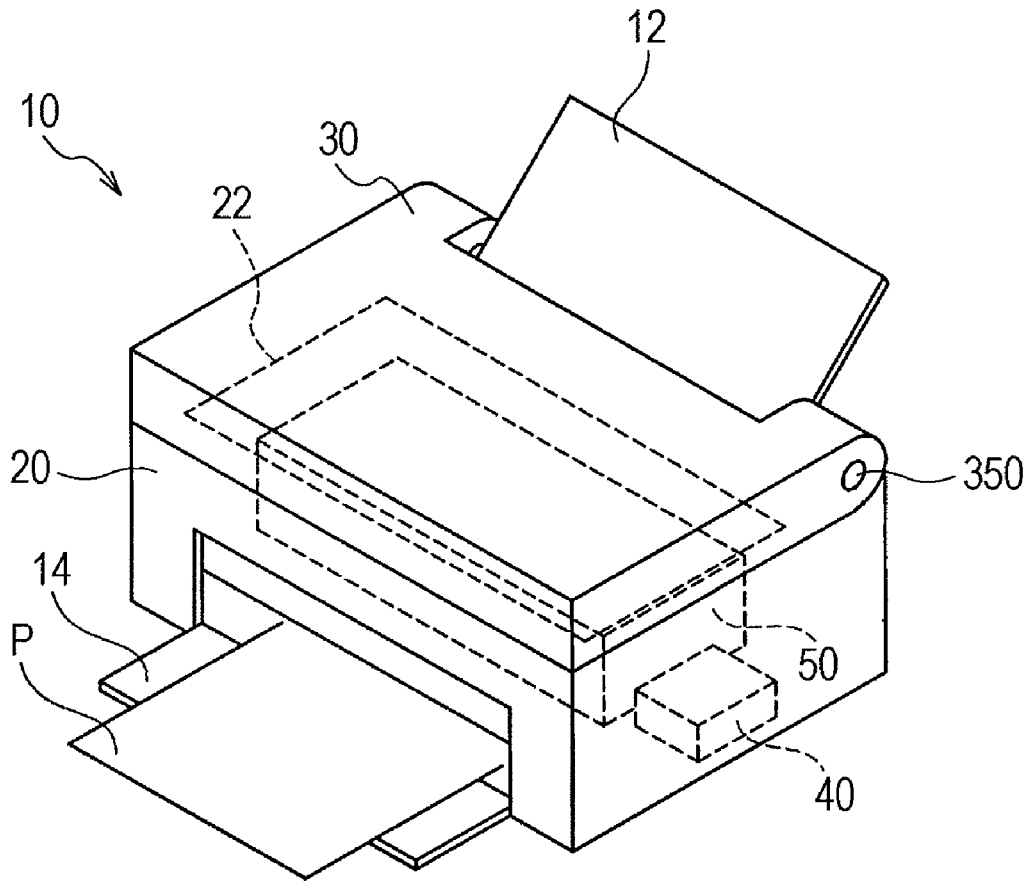
FIG. 1 is a perspective view illustrating the general configuration of a printer according to a first embodiment of the invention.

FIG. 1 illustrates the general configuration of a printer 10 according to an embodiment of the invention. The printer 10 is an ink jet type printer which records characters or diagrams by ejecting liquid ink on a printing paper P, which is a recording medium. Also, the printer 10 is a multi-function machine type printer and has a scanner function which optically reads in an image.

As shown in FIG. 1, the printer 10 includes a main body case 20 which houses a printing mechanism section 50, and at the main body case 20, there are arranged a paper feeding tray 12 for introducing the printing paper P which is to be fed into the printing mechanism section 50, into the main body case 20, and a paper receiving tray 14 for directing the printing paper P which has been discharged from the printing mechanism section 50, to the outside of the main body case 20. The detailed configuration of the printing mechanism section 50 will be described later.

A control section 40 for controlling each section of the printer 10 is also housed in the main body case 20. In this embodiment, the control section 40 includes Application Specific Integrated Circuits (ASICs) having hardware such as a Central Processing Unit (CPU), a Read Only Memory (ROM), a Random Access Memory (RAM), etc. The control section 40 is installed with software for realizing various functions of the printer 10.

Figure 2:
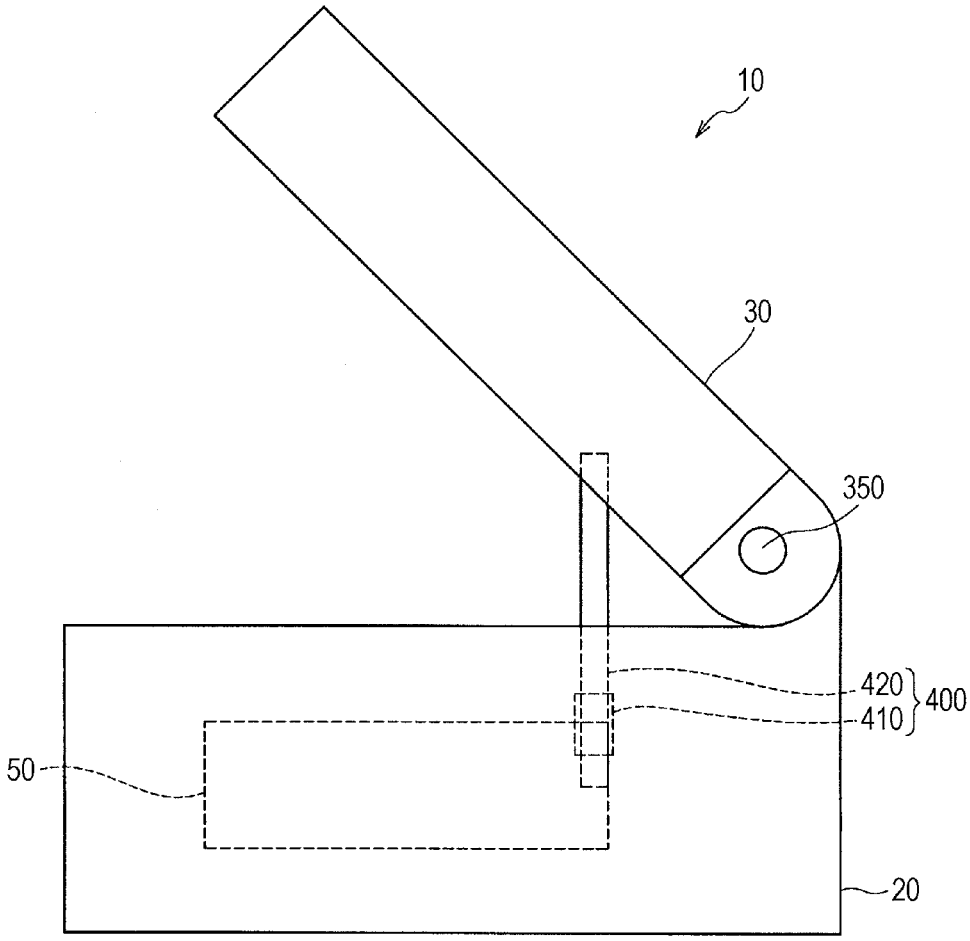
FIG. 2 is a side view illustrating a state in which the upper case of the printer is moved upward.

An upper case 30 is disposed on the upper portion of the main body case 20. In the upper case 30, there is a scanner mechanism (not shown) for providing the scanner function. The upper case 30 is mounted on the main body case 20 to be rotationally movable about a rotation shaft 350. FIG. 2 illustrates a state in which the upper case 30 of the printer 10 is moved upward. When the upper case 30 is rotationally moved upward about the rotation shaft 350, an opening section 22 (FIG. 1), provided in at least a portion of the upper face of the main body case 20, is opened. In this state, a user can get access to the printing mechanism section 50 through the opening section 22. When the upper case 30 is rotationally moved downward to cover the upper portion of the main body case 20 (referring to FIG. 1), the opening section 22 is closed. The upper case 30 corresponds to the opening and closing mechanism in the invention.

Figure 3A:
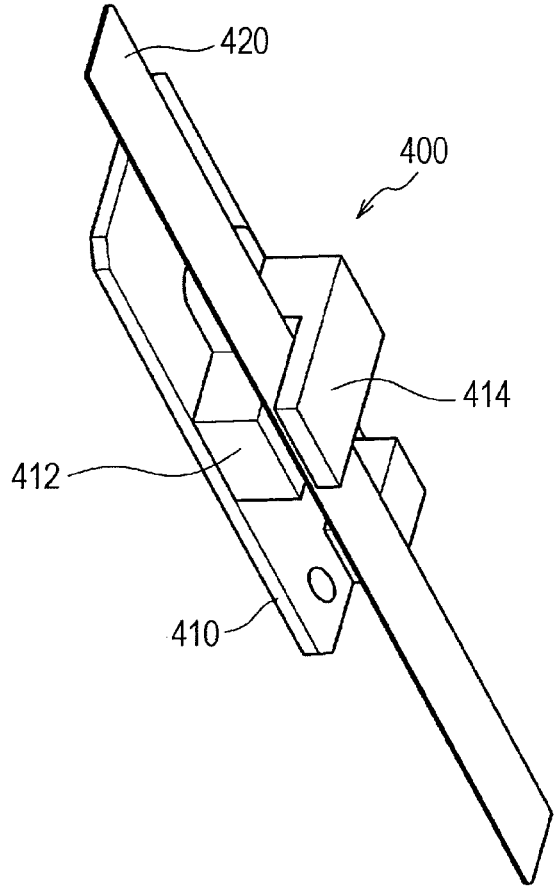
FIGS. 3A and 3B are perspective and facing views respectively illustrating the configuration of a sensor unit.
Figure 3B:
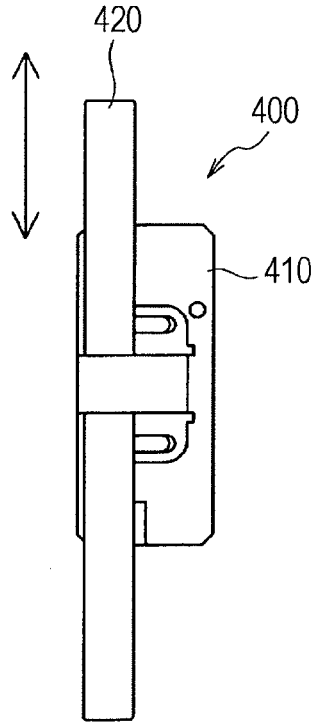

As shown in FIG. 2, the printer 10 includes a sensor unit 400. FIGS. 3A and 3B illustrate the configuration of the sensor unit 400. FIG. 3A is a perspective view of the sensor unit 400 and FIG. 3B is a front view of the sensor unit 400. As shown in FIGS. 2, 3A, and 3B, the sensor unit 400 includes a linear scale 420 and a sensor 410.

The linear scale 420 is joined to the upper case 30 (referring to FIG. 2) and reciprocates along the longitudinal direction thereof in accordance with the rotational movement of the upper case 30 (that is, the operation of opening and closing the opening section 22 of the main body case 20) (referring to the arrow in FIG. 3B). Further, the linear scale 420 has a plurality of slits (not shown) arranged at the predetermined intervals (for example, 180 dpi) along the longitudinal direction. The linear scale 420 corresponds to the first movable body in the invention.

The sensor 410 is a photo-interrupter sensor having a light emitting portion 412 and a light receiving portion 414, which face each other with the linear scale 420 interposed therebetween. The light emitting portion 412 emits light from a light emitting element (not shown), and the light receiving portion 414 receives the light emitted from the light emitting portion 412 by a light receiving element (not shown). The sensor 410 is fixed to the printing mechanism section 50 (or the main body case 20).

When the linear scale 420 is moved along the longitudinal direction in accordance with the rotational movement of the upper case 30, a light received state in which the light emitted from the light emitting portion 412 is received by the light receiving portion 414 through the slit of the linear scale 420, and a light non-received state in which the light emitted from the light emitting portion 412 is not received by the light receiving portion 414 by being interrupted by the linear scale 420, are alternately repeated. At this time, the light receiving portion 414 outputs a pulse signal representing the repetition of the light received state and the light non-received state. In this embodiment, the light receiving portion 414 outputs two pulse signals having different phases from each other. The sensor 410 detects the moving direction and displacement amount of the linear scale 420 on the basis of the phase shift and pulse number of two pulse signals. Also, the displacement amount of the linear scale 420 may also be expressed as a movement amount. Since the sensor unit 400 detects the movement amount of the linear scale 420, the sensor unit 400 corresponds to the movement detecting section in the invention.

Figure 4:
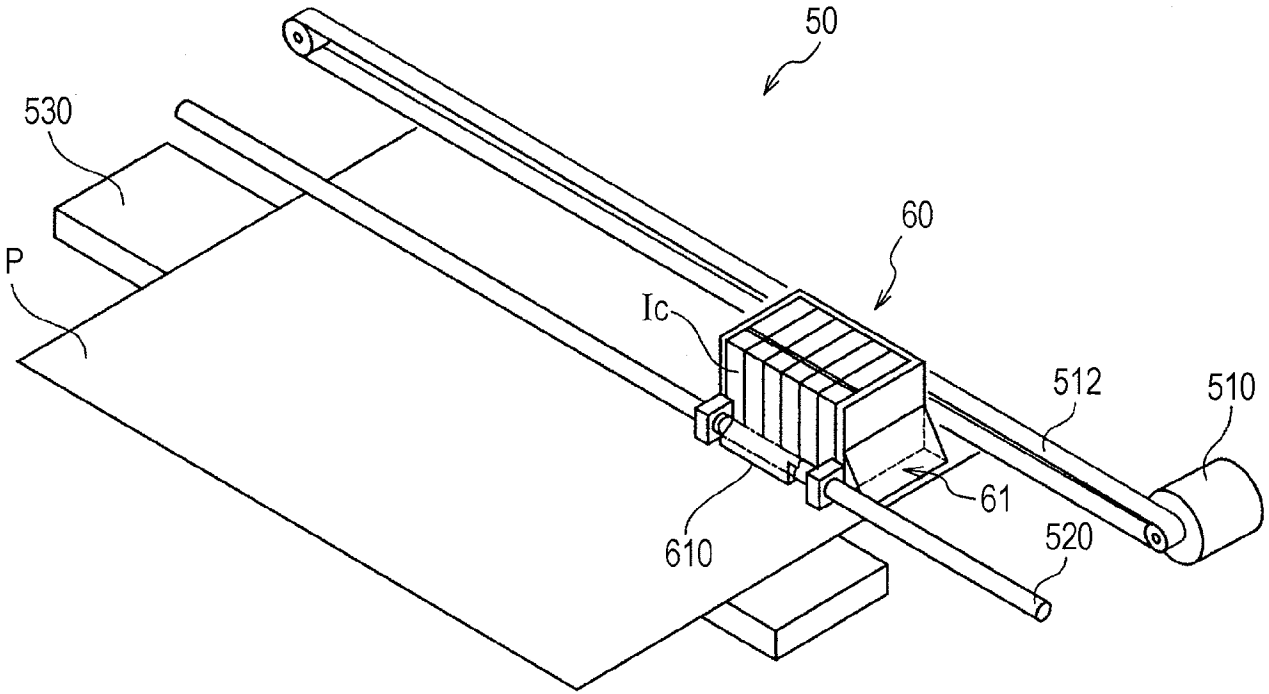
FIG. 4 is a perspective view illustrating the configuration of a printing mechanism section.

FIG. 4 is an explanatory view illustrating the configuration of the printing mechanism section 50. The printing mechanism section 50 includes a platen 530 of a rectangular shape, which is disposed at a printing area where the ejection of ink droplets on the printing paper P is carried out. The printing paper P is fed onto the platen 530 by a paper transporting mechanism (not shown). The printing mechanism section 50 further includes a carriage 60, in which an ink cartridge Ic is mounted and which has a recording head 610. The carriage 60 is supported on a guide rod 520 so as to be movable along the longitudinal direction of the platen 530, and driven by a carriage motor 510 through a timing belt 512. Accordingly, the carriage 60 reciprocates (main-scans) over the platen 530 along the longitudinal direction of the platen. The recording head 610 is supplied with ink from the ink cartridge Ic mounted in the carriage 60 and discharges the ink on the printing paper P. The carriage 60 corresponds to the second movable body in the invention.

As shown in FIG. 4, the carriage 60 has a tapered portion 61 of a generally triangular prism shape at the end of one side, and along the moving direction thereof.

Figure 5:
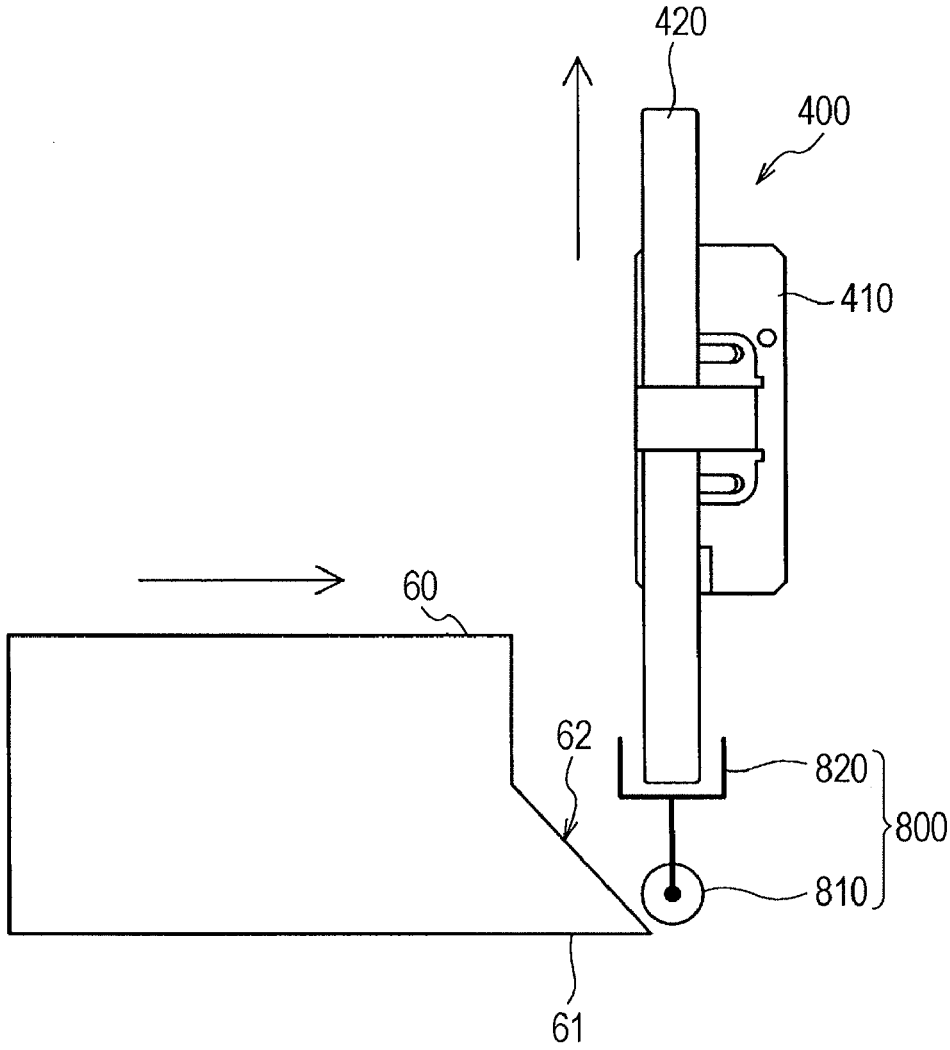
FIG. 5 is a schematic view illustrating the relation between a carriage and the sensor unit.

FIG. 5 illustrates the relation between the carriage 60 and the sensor unit 400. FIG. 5 is a diagram showing the carriage 60 and the sensor unit 400 as viewed from the side. As shown in FIG. 5, the printer 10 includes a transmission section 800 which is interposed between the carriage 60 and the sensor unit 400. The transmission section 800 includes a wheel portion 810 of a circular shape in cross section, and a support portion 820 connected to the wheel portion 810, and capable of supporting the lower end of the linear scale 420. Further, the transmission section 800 is disposed at such a position that when the carriage 60 is moved, the wheel portion 810 interferes in the tapered surface 62 of the tapered portion 61 of the carriage 60. Therefore, as the wheel portion 810 is ascended along the tapered surface 62 in accordance with the accession of the carriage 60, the transmission section 800 is pushed upwards as a whole. The tapered portion 61 of the carriage 60 and the transmission section 800 correspond to the movement transmitting mechanism.

In a closed state in which the upper case 30 covers the upper portion of the main body case 20, whereby the opening section 22 is closed (referring to FIG. 1), the transmission section 800 is arranged at such a position that the support portion 820 pushes up the linear scale 420 according to the upward movement of the transmission section 800 with the movement of the carriage 60. On the other hand, in an opened state in which the upper case 30 is moved upward, whereby the opening section 22 is opened (referring to FIG. 2) (namely, a state in which the linear scale 420 is moved upward), the transmission section 800 is arranged at such a position that even if the transmission section 800 is moved upward in accordance with the movement of the carriage 60, the support portion 820 does not interfere in the linear scale 420, thereby not pushing up the linear scale 420. Therefore, in the printer 10, in the closed state, the linear scale 420 can be moved upward in accordance with the movement of the carriage 60, whereas in the opened state, the linear scale 420 cannot be moved upward in accordance with the movement of the carriage 60.

In the printer 10 according to this embodiment, the control section 40 performs the decision of the opening and closing of the opening section 22 of the main body case 20 on the basis of the results detected by the sensor unit 400. That is, the control section 40 functions as the determination section in the invention. Specifically, the control section 40 determines whether the opening section 22 is closed or opened, by defining a state in which the upper case 30 covers the upper portion of the main body case 20, whereby the opening section 22 is closed, as a reference state, and detecting the position of the upper case 30 on the basis of the moving direction and displacement amount of the linear scale 420 from the reference state, which are detected by the sensor 410. Therefore, in the printer 10 according to this embodiment, the decision of the opening and closing of the opening section 22 can be performed with a high degree of accuracy irrespective of the variations of the dimension or position of each section of the printer 10.

Also, that the opening section 22 is closed may be considered, for example, a state in which the opening section 22 is completely closed by the opening and closing mechanism such as the upper case 30. In this case, when the detected displacement amount of the linear scale 420 from the reference state is zero, the control section 40 decides that the opening section 22 is closed, and when the detected displacement amount is greater than zero, the control section 40 decides that the opening section 22 is opened. Also, that the opening section 22 is closed is not limited to a state in which the opening section 22 is completely closed, but may include also a state in which the opening section 22 is opened only by a small amount. In this case, when the detected displacement amount of the linear scale 420 from the reference state is less than or equal to a predetermined threshold value, the control section 40 decides that the opening section 22 is closed, and when the detected displacement amount is greater than the predetermined threshold value, the control section 40 decides that the opening section 22 is opened.

Also, the control section 40 can also perform the decision of the opening and closing of the opening section 22 on the basis of the occurrence or nonoccurrence of the movement of the linear scale 420 according to the movement of the carriage 60. That is, when the carriage 60 is moved up to the position at which it can interfere in the transmission section 800, and the movement of the linear scale 420 according to the movement of the carriage 60 is detected by the sensor 410, the control section 40 decides that the opening section 22 is closed, and when the movement of the linear scale 420 according to the movement of the carriage 60 is not detected, the control section 40 decides that the opening section 22 is opened. Therefore, for example, the decision of the opening and closing of the opening section 22 is based on the moving direction and displacement amount of the linear scale 420 from the reference state, and is additionally based on the occurrence or nonoccurrence of the movement of the linear scale 420 according to the movement of the carriage 60. Only when in both decisions that the opening section 22 is closed have been given, the control section 40 can finally decide that the opening section 22 is really closed. Accordingly, even when there is a case where an erroneous decision that the opening section 22 is closed is given, the erroneous decision can be prevented by carrying out the decision of the opening and closing of the opening section 22 based on the occurrence or nonoccurrence of the movement of the linear scale 420 according to the movement of the carriage 60. Therefore, in the printer 10 according to this embodiment, the accuracy of the decision of the opening and closing of the opening section 22 of the main body case 20 can be improved.

Second Example

Figure 6:
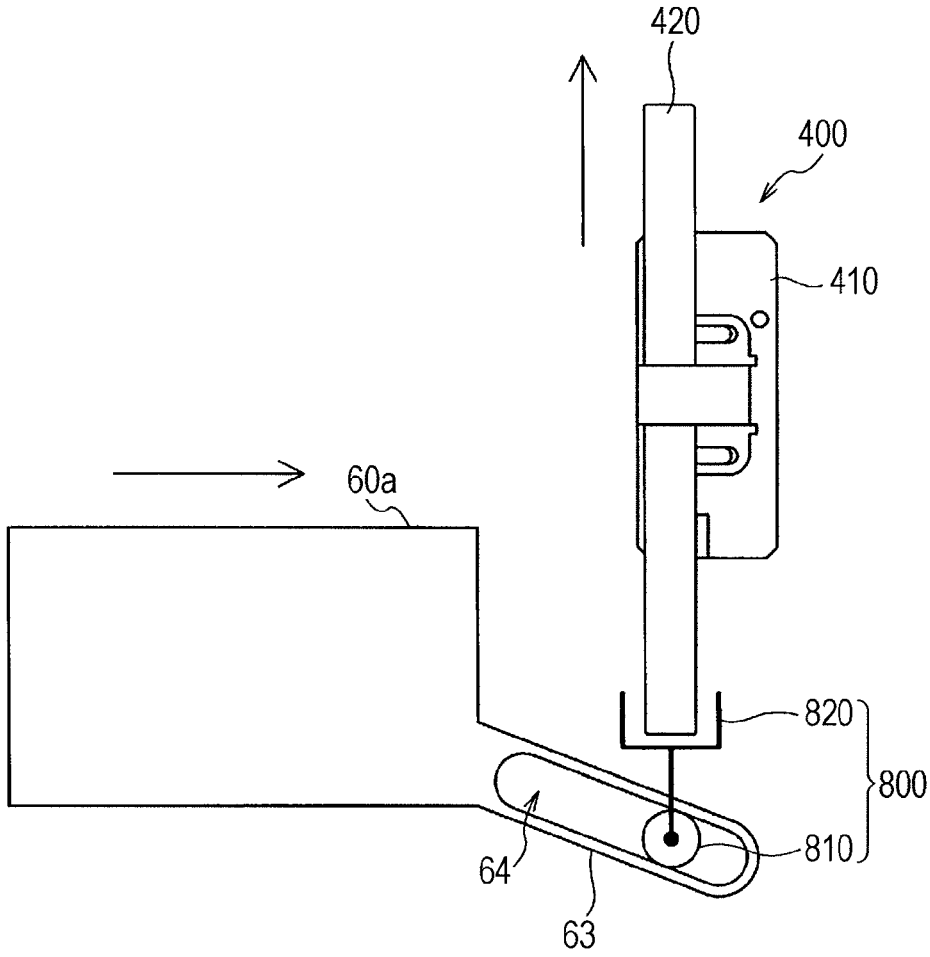
FIG. 6 is a schematic view illustrating the relation between the carriage and the sensor unit in a second embodiment.

FIG. 6 illustrates the relation between a carriage 60*a* and the sensor unit 400. FIG. 6 is a diagram showing the carriage 60*a* and the sensor unit 400 as viewed from the side. Also in the second embodiment, similarly to the first embodiment shown in FIG. 5, the transmission section 800 is interposed between the carriage 60*a* and the sensor unit 400. However, the relation between the carriage 60*a* and the transmission section 800 differs from what is shown in FIG. 5.

The carriage 60*a* has a rod-shaped connecting portion 63 extending obliquely downwardly from the carriage 60*a*. The connecting portion 63 has a hole portion 64 of a long ellipse shape and the wheel portion 810 of the transmission section 800 is sliding-movably fitted into the hole portion 64. The connecting portion 63 of the carriage 60*a* and the transmission section 800 correspond to the movement transmitting mechanism in the invention.

If the carriage 60*a* is moved toward the transmission section 800, the position of the wheel portion 810 in the hole portion 64 of the connecting portion 63 is moved upward, so that the transmission section 800 is pushed up upward as a whole. Therefore, the decision of the opening and closing of the opening section 22 based on the occurrence or nonoccurrence of the movement of the linear scale 420 according to the movement of the carriage 60*a* can be carried out, and therefore the accuracy of the decision of the opening and closing of the opening section 22 of the main body case 20 can be improved.

Third Example

Figure 7:
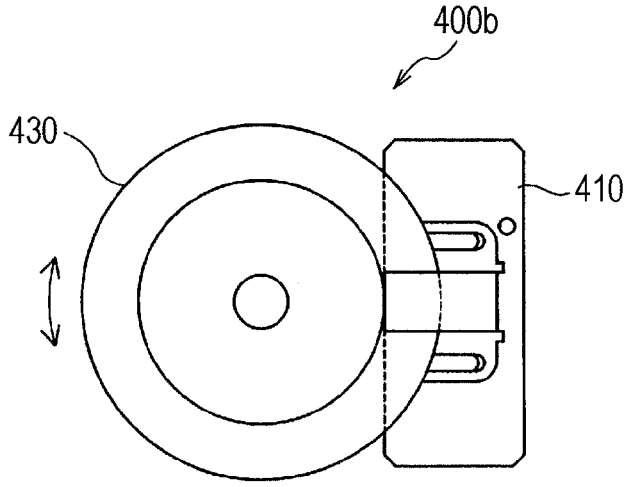
FIG. 7 is a facing view illustrating the general configuration of the sensor unit in a third embodiment.

FIG. 7 illustrates the general configuration of a sensor unit 400*b*. The sensor unit 400*b* differs from the sensor unit 400 (FIG. 3) in the first embodiment in that it has a rotary scale (rotating scale) 430 instead of the linear scale 420. The other configurations of the printer 10 according to the third example are identical with those in the first example.

The rotary scale 430 is joined to the upper case 30 through, for example, a link to rotate according to the rotational movement of the upper case 30 (that is, the operation of opening and closing the opening section 22 of the main body case 20) (referring to the arrow in FIG. 7). Further, the rotary scale 430 has a plurality of slits (not shown) arranged at the predetermined intervals along the circumferential direction. Similarly to the first example, the sensor 410 detects the rotating direction and rotation amount of the rotary scale 430 on the basis of the phase shift and pulse number of two pulse signals having different phases from each other. Also, the rotation amount of the rotary scale 430 may also be expressed as a movement amount. The rotary scale 430 corresponds to the first movable body in the invention.

Figure 8A:
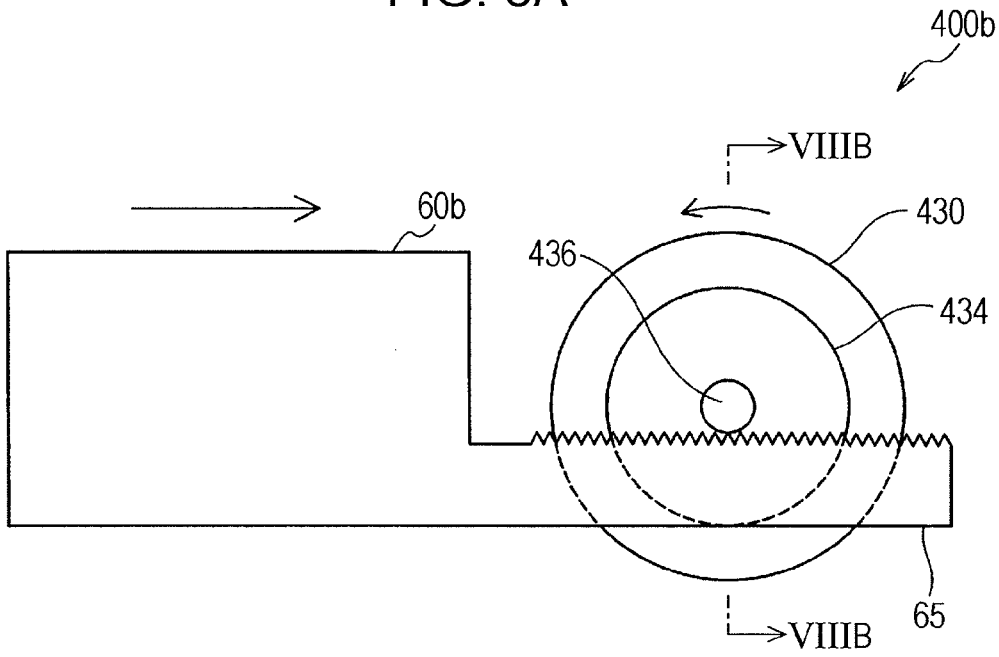
FIGS. 8A and 8B are schematic views illustrating the relation between the carriage and the sensor unit in the third embodiment.
Figure 8B:
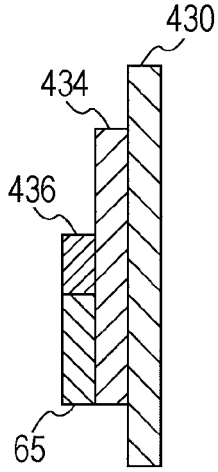

FIGS. 8A and 8B are explanatory views illustrating the relation between the carriage 60*b* and the sensor unit 400*b* in the third example. FIG. 8A is a diagram showing the carriage 60*b* and the sensor unit 400*b* as viewed from the side, and FIG. 8B is a cross-sectional view taken along line VIIIB-VIIIB of FIG. 8A. The carriage 60*b* has an arm portion 65 extending horizontally toward the sensor unit 400*b*. As shown in FIG. 8A, a plurality of teeth are formed in the upper surface of the arm portion 65. Also, the rotary scale 430 is connected to a gear 436 with an intermediate member 434 interposed therebetween. The teeth of the gear 436 are in intermeshing engagement with the teeth of the arm portion 65, so that the gear 436 rotates in accordance with the horizontal movement of the carriage 60*b* (the arm portion 65 thereof). Therefore, the rotary scale 430 also rotates in accordance with the horizontal movement of the carriage 60*b* (the arm portion 65 thereof). The arm portion 65 of the carriage 60*b* and the gear 436 correspond to the movement transmitting mechanism in the invention.

The positional relation between the arm portion 65 and the gear 436 becomes arranged such that in the closed state in which the upper case 30 covers the upper portion of the main body case 20, whereby the opening section 22 is closed (referring to FIG. 1), the teeth of the gear 436 are in intermeshing engagement with the teeth of the arm portion 65. In the opened state in which the upper case 30 is moved upward, whereby the opening section 22 is opened (referring to FIG. 2) (namely, a state in which the rotary scale 430 and the gear 436 have been moved upward), the teeth of the gear 436 are not in intermeshing engagement with the teeth of the arm portion 65. Accordingly, in the closed state, the rotary scale 430 can be rotated according to the movement of the carriage 60*b*, whereas in the opened state, the rotary scale 430 cannot be rotated according to the movement of the carriage 60*b*.

Also in the third example, since the rotary scale 430 rotates according to the rotational movement of the upper case 30 (that is, the operation of opening and closing the opening section 22 of the main body case 20), the decision of the opening and closing of the opening section 22 of the main body case 20 can be carried out on the basis of the detected results of the rotating direction and rotation amount of the rotary scale 430 by the sensor unit 400*b*. Therefore the decision of the opening and closing of the opening section 22 can be performed with a high degree of accuracy irrespective of the variations of the dimension or position of each section of the printer 10. Further, since the decision of the opening and closing of the opening section 22 can be carried out on the basis of the occurrence or nonoccurrence of the rotation of the rotary scale 430 according to the movement of the carriage 60*b*, the accuracy of the decision of the opening and closing of the opening section 22 of the main body case 20 can be improved.

Fourth Example

Figure 9:
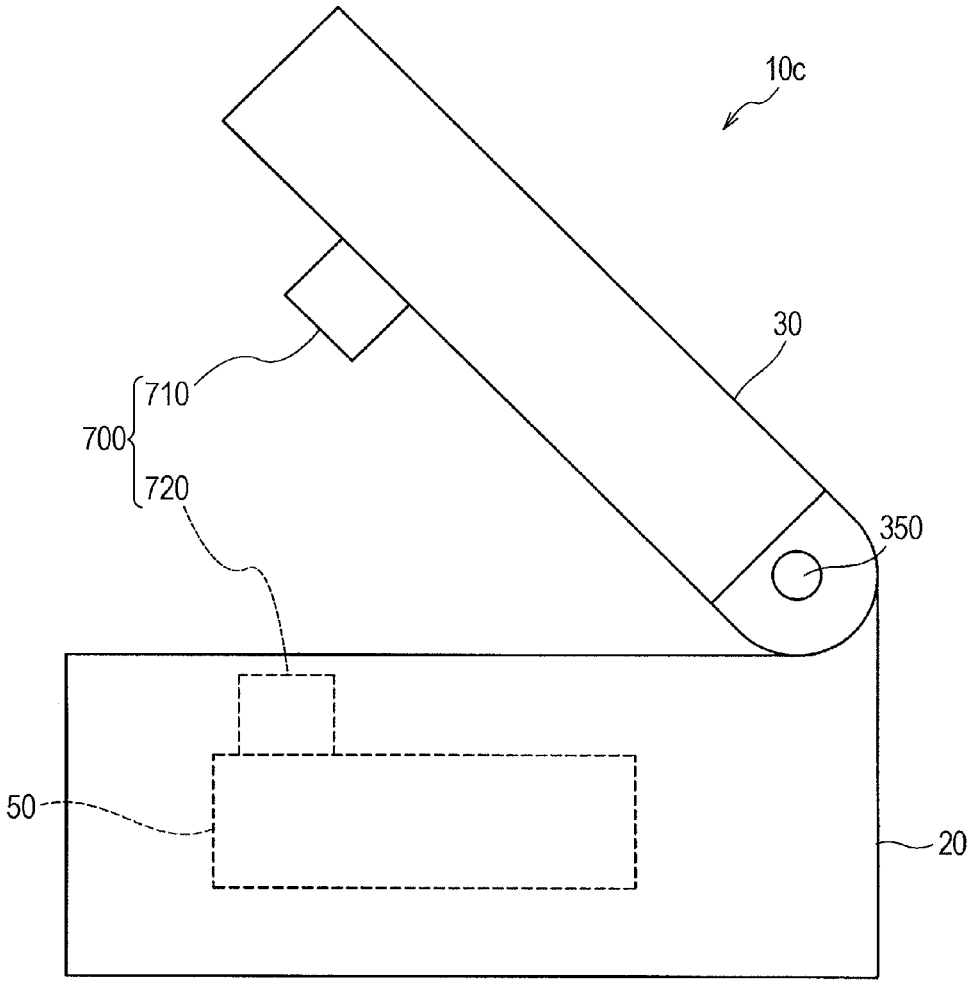
FIG. 9 is a side view schematically illustrating the configuration of a printer according to a fourth embodiment.

FIG. 9 illustrates the configuration of the printer 10*c*. The configuration of a sensor unit 700 differs from the sensor unit 400 in the first embodiment shown in FIG. 2. The other configurations of the printer 10*c* according to the fourth example are identical with those in the first example.

The sensor unit 700 in the fourth embodiment includes a light emitting portion 710, a light receiving portion 720, and a linear scale 730 described later. As shown in FIG. 9, the light emitting portion 710 is joined to the upper case 30, so that it is moved up and down according to the rotational movement of the upper case 30 (that is, the operation of opening and closing the opening section 22 of the main body case 20). Also, the light receiving portion 720 is fixed to the printing mechanism section 50 (or the main body case 20). Namely, the relative position relation between the light emitting portion 710 and the light receiving portion 720 varies with the rotational movement of the upper case 30. In the closed state in which the upper case 30 covers the upper portion of the main body case 20, whereby the opening section 22 is closed, the optical axes of the light emitting portion 710 and light receiving portion 720 are aligned, so that the light receiving portion 720 is in a state in which it can receive the light emitted from the light emitting portion 710. On the other hand, in the opening opened state in which the upper case 30 is rotationally moved upward, whereby the opening section 22 is opened, the optical axes of the light emitting portion 710 and light receiving portion 720 are not aligned, so that the light receiving portion 720 is in a state in which it cannot receive the light emitted from the light emitting portion 710.

Figure 10:
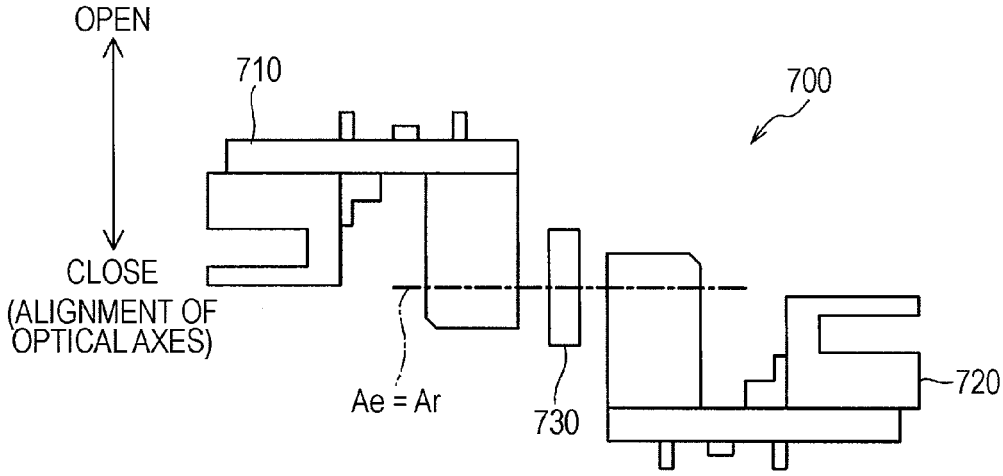
FIG. 10 is a schematic view illustrating the configuration of the sensor unit in the fourth embodiment.

FIG. 10 is a diagram showing the sensor unit 700 in a state in which the optical axis Ae of the light emitting portion 710 and the optical axis Ar of the light receiving portion 720 are aligned (that is, the opening closed state), as viewed from the side. The linear scale 730 of the sensor unit 700 is arranged at such a position that in a state in which the optical axis Ae of the light emitting portion 710 and the optical axis Ar of the light receiving portion 720 are aligned, it interferes in the optical axes. That is, in the closed state in which the opening section 22 is closed, the linear scale 730 is located in the path of light from the light emitting portion 710 to the light receiving portion 720. Further, the linear scale 730 has a plurality of slits (not shown) arranged at the predetermined intervals along the longitudinal direction (horizontal direction).

Figure 11:
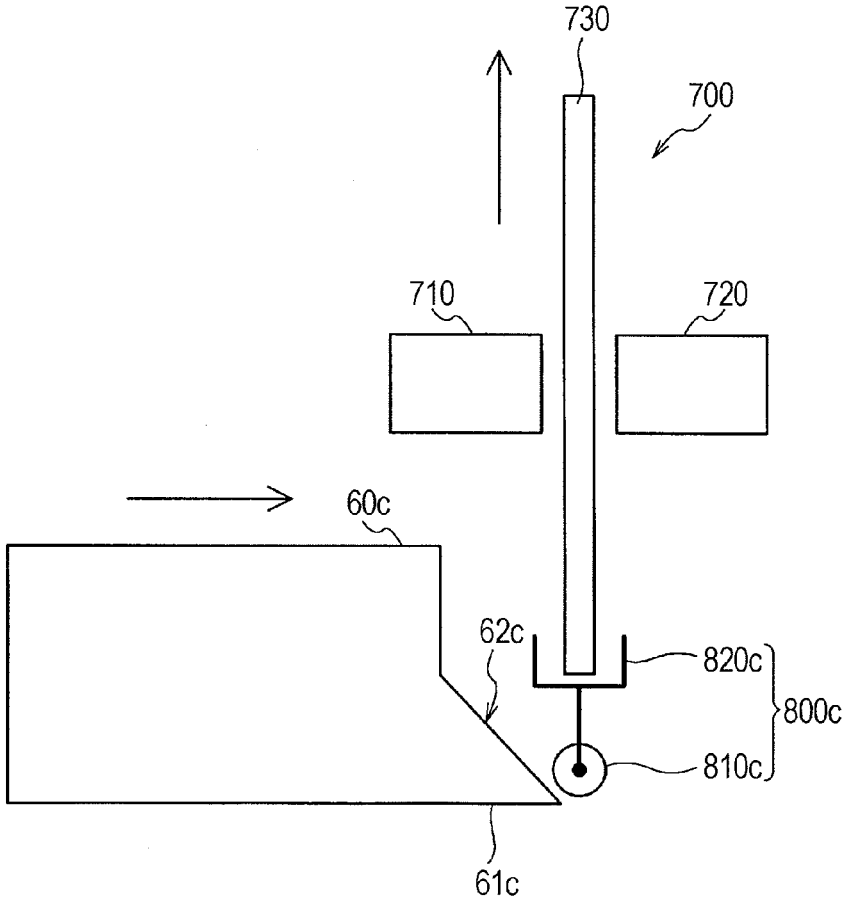
FIG. 11 is a schematic view illustrating the relation between the carriage and the sensor unit in the fourth embodiment.

FIG. 11 is a diagram showing the carriage 60*c* and the sensor unit 700 as viewed from above. Similarly to the first example, the carriage 60*c* has a tapered portion 61*c*. However, the tapered portion 61*c* differs from the tapered portion 61 in the first embodiment in that a tapered surface 62*c* thereof is provided at the lateral side, but not the upside. Also, a printer 10*c* according to this embodiment includes a transmission section 800*c* which is interposed between the carriage 60*c* and the sensor unit 700. Similarly to the first example, the transmission section 800*c* includes a wheel portion 810*c* and a support portion 820*c*. The transmission section 800*c* is disposed at such a position that if the carriage 60*c* is moved, the wheel portion 810*c* interferes in the tapered surface 62*c* of the tapered portion 61*c* of the carriage 60*c*. Therefore, as the wheel portion 810*c* is horizontally moved along the tapered surface 62*c* in accordance with the accession of the carriage 60*c*, the transmission section 800*c* is horizontally moved as a whole. Further, the transmission section 800*c* is arranged at such a position that the support portion 820*c* horizontally moves the linear scale 730 according to the horizontal movement of the transmission section 800*c* with the movement of the carriage 60*c*. The moving direction of the linear scale 730 at this time corresponds to the arrangement direction of a plurality of slits (referring to the arrow of FIG. 11).

In the state shown in FIG. 10 in which the optical axis Ae of the light emitting portion 710 and the optical axis Ar of the light receiving portion 720 are aligned (that is, the opening closed state), the sensor unit 700 can detect the movement of the linear scale 730. That is, when the linear scale 730 is stopped, the light receiving portion 720 always outputs a signal representing the light received state, meanwhile, when the linear scale 730 is moved, the light receiving portion 720 outputs pulse signals representing the repetition of the light received state and the light non-received state. Therefore, if the light receiving portion 720 outputs the pulse signals, the movement of the linear scale 730 is detected. On the other hand, in a state in which the optical axis Ae of the light emitting portion 710 and the optical axis Ar of the light receiving portion 720 are not aligned (that is, the opening opened state), the light receiving portion 720 always outputs a signal representing the light non-received state, irrespective of the occurrence or nonoccurrence of the movement of the linear scale 730, so that the sensor unit 700 cannot detect the movement of the linear scale 730.

In the printer 10*c*, the control section 40 performs the decision of the opening and closing of the upper case 22 of the main body case 20 by detecting the alignment of the optical axes of the light emitting portion 710 and light receiving portion 720. That is, the control section 40 functions as the determination section in the invention. Specifically, when the control section 40 has detected that the light receiving portion 720 always outputs the signal representing the light received state, the control section 40 decides that the opening section 22 is closed. On the other hand, when the control section 40 has detected that the light receiving portion 720 always outputs the signal representing the light non-received state, the control section 40 decides that the opening section 22 is opened.

Further, the control section 40 can carry out the decision of the opening and closing of the opening section 22 on the basis of the detection or non-detection of the movement of the linear scale 730 in accordance with the movement of the carriage 60*c*. That is, by moving the carriage 60*c* up to a position at which it interferes in the transmission section 800*c*, and thus moving the linear scale 730, the control section 40 determines whether or not the movement of the linear scale 730 is detected by the sensor unit 700. If the movement of the linear scale 730 is detected, the control section 40 decides that the opening section 22 is closed, and if the movement of the linear scale 730 has not been detected, the control section 40 decides that the opening section 22 is opened. An erroneous decision of the opening and closing of the opening section 22 by the detection of the alignment of the optical axes of the light emitting portion 710 and light receiving portion 720, can be prevented by carrying out the decision of the opening and closing of the opening section based on the detection or non-detection of the movement of the linear scale 730 in accordance with the movement of the carriage 60*c*. Therefore, in the printer 10*c* according to the fourth example, the accuracy of the decision of the opening and closing of the opening section 22 of the main body case 20 can be improved.

MODIFICATION EXAMPLES

Also, the invention is not to be limited to the examples and the embodiments described above, but can be implemented in various aspects within the scope not departing from the essential points thereof, and, for example, the following modification examples are also possible.

First Modification Example

In each example described above, the printer 10 is a multifunction machine type printer. However, the printer 10 may also be a single function type printer having no scanner function. In this case, the opening section 22 may be opened and closed by a cover. Also, although the printer 10 has been described as being a so-called on-carriage type printer in which the ink cartridge Ic is mounted in the carriage 60, the printer 10 may also be a so-called off-carriage type printer in which the ink cartridge Ic is not mounted in the carriage 60. Also, the printer 10 is not limited to the ink jet type printer, but may also be the other type printer (for example, laser printer).

Also, in each example described above, description was made to the decision of the opening and closing of the opening section 22 of the main body case 20. However, the invention can be applied also to the decision of the opening and closing of another opening section (for example, the opening section for discharging a printed paper, which is opened and closed by the printed paper receiving tray 14 (referring to FIG. 1)). Also, in each example described above, description was made to the decision of the opening and closing of the opening section provided at the printer 10. However, the invention is not limited to the printer 10, but can also be applied to the decision of the opening and closing of the opening section provided at a general apparatus. Also, in each embodiment described above, the position of the upper case 30 can be detected with good precision, and therefore the invention is not limited to the decision of the opening and closing of the opening section, but can also be applied to the decision of the opening amount (extent of opening) of the opening and closing mechanism.

Second Modification Example

In each example described above, as the sensor, a sensor in which a light emitting portion (light emitting portion 412 or 710) and a light receiving portion (light receiving portion 414 or 720) are disposed to face each other is adopted. However, a reflection type sensor in which a light emitting portion and a light receiving portion are disposed in parallel can also be adopted.

Third Modification Example

In each example described above, as the first movable body, the linear scale 420, the rotary scale 430, the linear scale 730, or the like is adopted. However, the first movable body does not necessarily have to be a scale. Also, in each example described above, as the movement detecting section for detecting the movement amount of the first movable body, the sensor unit 400 or 700 is adopted. However, as long as the movement detecting section is one that detects the movement amount of the first movable body, it does not necessarily have to be a sensor. Also, for example, in the first example, the configuration may also be arranged such that the sensor 410 is connected to the upper case 30, thereby being moved up and down in accordance with the rotational movement of the upper case 30, and the linear scale 420 is fixed to the printing mechanism section 50 (or the main body case 20). In this case, the sensor 410 corresponds to the first movable body.

Also, in each example described above, as the second movable body, the carriage 60 (60*a*, 60*b*, or 60*c*) is adopted. However, the second movable body may be any other movable element. For example, in a case where the printer has a processing gap adjusting mechanism (APG: Auto Platen Gap mechanism) for adjusting a gap between the surface of the platen 530 and the recording head 610 for print processing on the printing paper P different in thickness, or direct printing on a CD-R surface (referring to JP-A-2008-80649), the processing gap adjusting mechanism can also be used as the second movable body. Also, in a case in which the printer has an EJ frame (paper discharging frame), the EJ frame can also be used as the second movable body.

Fourth Modification Example

In the fourth example described above, the configuration is arranged such that the linear scale 730 is horizontally moved in accordance with the movement of the carriage 60*c* irrespective of whether the printer is in the closed state or the opened state. However, it may also be adopted that the linear scale 730 is moved in accordance with the movement of the upper case 30 (that is, the operation of opening and closing the opening section 22) and in the opening opened state, the linear scale 730 is not horizontally moved in accordance with the movement of the carriage 60*c*. Also, the moving direction of the linear scale 730 in accordance with the movement of the carriage 60*c* is not limited to the horizontal direction, but may also be either a vertical direction or an inclined direction.

Also, in the fourth example described above, the light emitting portion 710 is connected to the upper case 30 and the light receiving portion 720 is fixed to the printing mechanism section 50 (or the main body case 20). However, to the contrary, the configuration may also be arranged such that the light receiving portion 720 is connected to the upper case 30 and the light emitting portion 710 is fixed to the printing mechanism section 50 (or the main body case 20).

Also, in the fourth example described above, as the first movable body, the linear scale 730 is adopted. However, instead of the linear scale 730, a rotating scale which has a plurality of slits along the circumferential direction thereof and rotates in accordance with movement of the carriage 60*c* can also be used.

Fifth Modification Example

In each example described above, the configuration in which the tapered portion 61, the connecting portion 63, or the arm portion 65 is integrated with the carriage 60 is adopted. However, the configuration in which the tapered portion 61, the connecting portion 63, or the arm portion 65 is separated from the carriage 60 may also be adopted. Even in this case, the configuration may be arranged such that the tapered portion 61, the connecting portion 63, or the arm portion 65, as a separate body, is moved in accordance with the movement of the carriage 60.

Further, as in each example described above, in a case where the configuration is adopted in which the tapered portion 61, the connecting portion 63, or the arm portion 65 is integrated with the carriage 60, the carriage 60 is designed so as not to protrude from the printer 10.

Sixth Modification Example

In the fourth example described above, a portion of the configuration which is realized by hardware may be replaced with software, and to the contrary, a portion of the configuration which is realized by software may be replaced with hardware.

Also, in a case where a part or all of the functions of the invention are realized by software, the software (computer program) may be provided in the form stored in a computer-readable recording medium. In the invention, the "computer-readable recording medium" is not limited to a portable recording medium such as a flexible disc or CD-ROM, but also includes an internal storage device in a computer, such as various RAM, ROM, and the like, or an external storage device fixed to a computer, such as a hard disc.

What is claimed is:

1. An apparatus comprising:

an opening and closing mechanism that opens or closes an opening section of the apparatus;

a first movable body that is moved in accordance with the operation of opening and closing the opening section by the opening and closing mechanism;

a movement detector that detects the movement amount of the first movable body;

a controller that determines whether or not the opening section is closed, on the basis of the detected movement amount;

a second movable body disposed in the apparatus; and a movement transmitter which moves the first movable body in accordance with the movement of the second movable body in a state in which the opening section is closed, and does not move the first movable body in accordance with the movement of the second movable body in a state in which the opening section is opened.

2. The apparatus according to claim 1, wherein the first movable body is a linear scale which reciprocates in accordance with the opening and closing the opening section by the opening and closing mechanism.

3. The apparatus according to claim 2, wherein the movement transmitter moves the linear scale in accordance with the movement of the second movable body in a state in which the opening section is closed.

4. The apparatus according to claim 3, wherein the movement transmitter comprises a wheel portion coupled to a support portion.

5. The apparatus according to claim 4, wherein the wheel portion is moveably coupled to the second movable body and the support portion is moveably coupled to the linear scale when the opening section is closed.

6. The apparatus according to claim 5, wherein the wheel is slidably housed within the second moveable body.

7. The apparatus according to claim 2, wherein the first movable body has a plurality of slits arranged along the movement direction thereof.

8. The apparatus according to claim 7, wherein the movement detector comprises a light emitting portion for emitting light, and a light receiving portion for receiving the light emitted from the light emitting portion, the plurality of slits being placed between the light emitting and receiving portions.

9. The apparatus according to claim 8, wherein the movement detector detects the movement amount of the first movable body on the basis of signals representing a light received state by the light receiving portion.

10. The apparatus according to claim 9, wherein the movement transmitting mechanism rotates the rotating scale in accordance with the movement of the second movable body in a state in which the opening section is closed.

11. The apparatus according to claim 10, wherein the rotating scale is connected to an intermediate member, the intermediate member being connected to a gear.

12. The apparatus according to claim 11, wherein the gear is intermeshed with the second moveable body when the opening section is closed.

13. The apparatus according to claim 1, wherein the first movable body is a rotary scale which rotates in accordance with the operation of opening and closing the opening section by the opening and closing mechanism.

14. The apparatus according to claim 13, wherein the rotary scale comprises a plurality of slits circumferentially spaced about the rotary scale.

15. The apparatus according to claim 14, wherein the movement detector comprises a light emitting portion for emitting light, and a light receiving portion for receiving the light emitted from the light emitting portion, the plurality of slits being placed between the light emitting and receiving portions.

16. The apparatus according to claim 15, wherein the movement detector detects the movement amount of the first movable body on the basis of signals representing a light received state by the light receiving portion.

17. The apparatus according to claim 1, wherein the second movable body is a carriage which reciprocates in the apparatus.

18. The apparatus according to claim 17, wherein the carriage comprises a tapered portion which can interfere with the movement transmitter.

19. The apparatus according to claim 17, wherein the carriage comprises an arm portion with a plurality of teeth which can interfere with the movement transmitter.

20. The apparatus according to claim 1, wherein the controller is configured to detect that the opening section is open based on moving the second moveable body to interfere with the first moveable body and detecting that the first moveably body has not been moved.

* * * * *